United States Patent [19]

Tielemans et al.

[11] 4,374,339

[45] * Feb. 15, 1983

[54] HIGH-PRESSURE SODIUM VAPOR DISCHARGE LAMP

[75] Inventors: Peter A. W. Tielemans; Cornelis A. J. Jacobs, both of Eindhoven, Netherlands

[73] Assignee: U.S. Philips Corporation, New York, N.Y.

[ * ] Notice: The portion of the term of this patent subsequent to Mar. 30, 1999, has been disclaimed.

[21] Appl. No.: 151,500

[22] Filed: May 19, 1980

[30] Foreign Application Priority Data

May 28, 1979 [NL] Netherlands ..... 7904158
Jan. 18, 1980 [NL] Netherlands ..... 8000326

[51] Int. Cl.[3] ..... H01J 61/073; H01J 61/22

[52] U.S. Cl. ..... 313/218; 313/213; 313/229

[58] Field of Search ..... 313/218, 213, 229

[56] References Cited

U.S. PATENT DOCUMENTS 4,052,634 10/1977 De Kok ..... 313/218 X
4,152,619 5/1979 Bhalla ..... 313/213 X
4,152,620 5/1979 Bhalla ..... 313/218
4,253,037 2/1981 Driessen et al. ..... 313/229 X
4,322,654 3/1982 Tielemans et al. ..... 313/213 X

FOREIGN PATENT DOCUMENTS 2753039 6/1978 Fed. Rep. of Germany ..... 313/218

*Primary Examiner*—Palmer C. Demeo
*Attorney, Agent, or Firm*—Robert S. Smith

[57] ABSTRACT

High-pressure sodium vapor discharge lamps having a color temperature of 2250 to 2750 K. and a color rendition index Ra of 60–85 emit light of a strongly reduced Ra already after approximately 2000 hours in operation. As compared with the life of normal, yellow high-pressure sodium vapor discharge lamps, this period is very short.

The discharge vessel contains sodium, mercury and a rare gas, the weight ratio Na/Hg being from 1/1 to 1/9 and the sodium pressure during operation of the lamp being from $4\times10^4$ to $10.7\times10^4$ Pa. The rare gas pressure in the discharge vessel at 300 K. is between 1333 and $1333\times10^2$ Pa.

By using an emitter which contains oxygen-bound strontium and oxygen-bound tungsten in a molar ratio from 3/1 to 50/1, the initial properties of such white-light-producing lamps are maintained for a long period of time.

1 Claim, 2 Drawing Figures

HIGH-PRESSURE SODIUM VAPOR DISCHARGE LAMP

Figure 1:
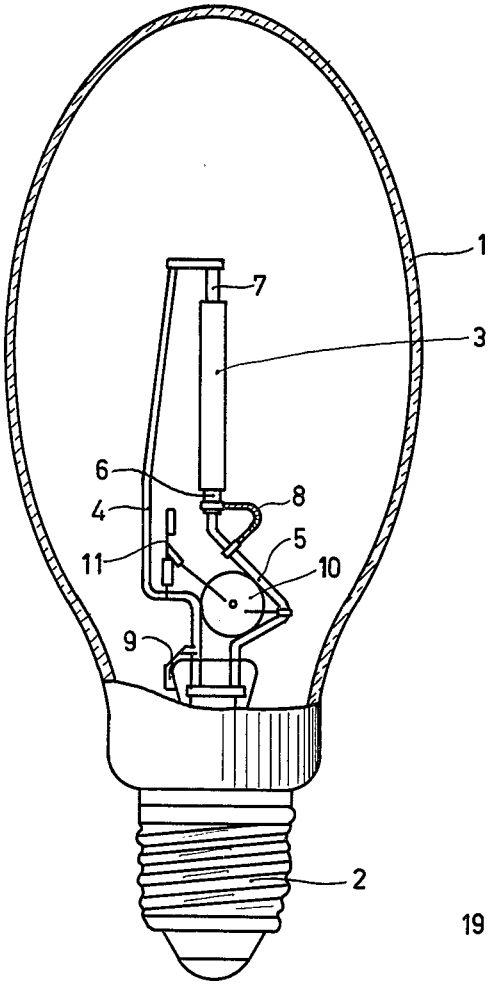

The invention relates to a high-pressure sodium vapour discharge lamp having a sealed ceramic discharge vessel containing sodium, mercury and rare gas, in which the weight ratio Na/Hg is from 1/1 to 1/9 and the sodium pressure during operation at design voltage is from $4\times10^4$ to $10.7\times10^4$ Pa, current supply conductors extending through the wall of the discharge vessel to tungsten electrodes accommodated inside the discharge vessel.

Such a high-pressure sodium vapor discharge lamp is disclosed in Netherlands Patent Application 7801972 to which U.K. Patent Application 7905714 and U.S. Pat. No. 4,253,037 correspond. A remarkable property of such a lamp is that it radiates substantially white light, that is light having a color temperature of 2250 to 2750 K and a color rendering index Ra from 60–85.

It is to be noted that "ceramic discharge vessel" is to be understood to mean herein a discharge vessel consisting of monocrystalline or polycrystalline material, for example, aluminium oxide.

In the white-light producing discharge lamp described, an electron emitter on the electrode is used consisting of oxygen-bound barium, oxygen-bound calcium and oxygen-bound yttrium in a mol ratio of 1:1:1, together with oxygen-bound tungsten, which emitter is known from U.S. Pat. No. 4,052,634.

White-light-producing high-pressure sodium vapor discharge lamps are destined to be used in those cases where accent illumination is desired and a good color rendition is required. It has been found, however, that a lamp of the kind described in the opening paragraph of the present specification loses its initial properties comparatively rapidly and starts emitting light having a much lower Ra. A very considerable decrease of the color rendering index can be observed even after an operating a period of approximately 2000 hours, a period which, compared with the life of normal yellow high pressure sodium vapor discharge lamps, is short.

The decrease of the color rendering index indicates that sodium is withdrawn from the discharge. However, it has not yet been found out to what mechanism this is to be ascribed.

It is the object of the invention to provide high-pressure sodium vapor discharge lamps which emit light having a color temperature of 2250–2750 K and a high color rendering index, Ra, for a longer period in operation.

The invention provides a high-pressure sodium vapor discharge lamp having a sealed ceramic discharge vessel containing sodium, mercury and rare gas, in which the weight ratio Na/Hg is from 1/1 to 1/9 and the sodium pressure during operation at design voltage is from $4.10^4$ to $10.7\times10^4$ Pa, current supply conductors extending through the wall of said discharge vessel to tungsten electrodes accommodated inside the discharge vessel, characterized in that an emitter is present on the electrodes which contains oxygen-bound strontium and oxygen-bound tungsten in a molar ratio from 3/1 to 50/1, and in which discharge vessel the rare gas pressure at 300° K. is between 1333 and $1333\times10^2$ Pa.

The emitter may be provided in various manners. For example, the electrodes which usually consist of a tungsten pin around which tungsten wire is wound at its free end, are dipped in a suspension of the emitter in, for example, methyl alcohol or butyl acetate to which a binder may have been added, for example, nitrocellulose.

The emitter may also be prepared on the electrode. In this case the electrode is provided with a suspension of strontium peroxide, strontium hydroxide, strontium carbonate or strontium formate or with another strontium salt which upon heating is converted to the oxide. Alternatively, a suspension of a mixture of strontium compounds may be used.

After evaporation of the suspension medium, the excess material can be removed easily from the electrode. The electrodes are then heated. If oxidizing gases are released, for example carbon dioxide when carbonates are used, oxidation of the tungsten electrode occurs so that oxidized tungsten is present in the emitter material. However, it is also possible for the suspension used to contain tungsten oxide or a tungstate.

Heating of the electrodes, usually for a few to a few tens of minutes, for example from 3 to 50 minutes at 850° to 1800° C., produces, in addition to the formation of strontium oxide from other strontium compounds, also the adhesion of the emitter material to the electrode.

In lamps according to the invention, the molar ratio of oxygen-bound strontium to oxygen-bound tungsten is generally between 3/1 and 15/1.

Rare gases such as xenon, argon and neon may be used as a starter gas in the lamps. Due to the higher efficiency which is achieved, xenon is to be preferred. The filling pressure of the rare gas is between 1333 and $1333\times10^2$ Pa, but, due to the higher efficiency and the smaller evaporation of the tungsten electrode material which are then realized, preferably lies between $1333\times10^1$ and $1333\times10^2$ Pa.

The lamps according to the invention preferably have a Na/Hg weight ratio $>1/4$, in particular $\geqq 1/2$, because then the color of the emitted light increasingly better resembles that of light of incandescent lamps.

The efficiency of lamps according to the invention is approximately 5 times as high as that of incandescent lamps. The lamps are particularly suitable for use instead of incandescent lamps, in particular in those cases where concentrated light beams are desired.

Figure 2:
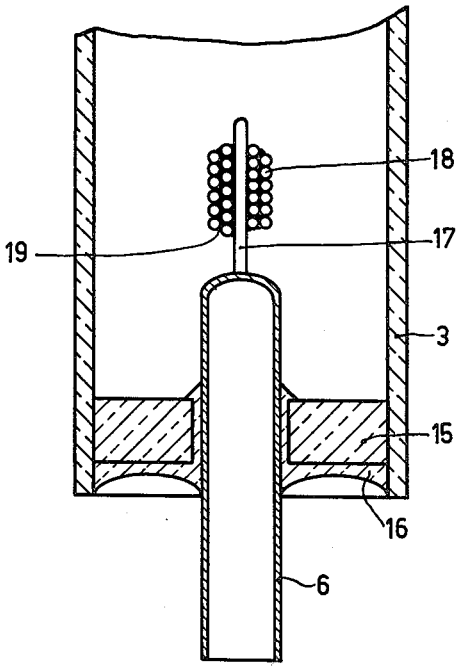

Embodiments of lamps according to the invention will be explained in greater detail with reference to the following Examples and to the drawing, in which:

FIG. 1 is a side elevation, partly broken away, of a high-pressure sodium vapor discharge lamp, and FIG. 2 is a side-sectional elevation of one end of a discharge vessel of a high-pressure sodium vapor discharge lamp.

In FIG. 1, a discharge vessel 3 is accommodated between current supply conductors 4 and 5 in a glass outer envelope 1 which has a lamp cap 2. Niobium tubes 6 and 7 conduct the current through the wall of the discharge vessel 3 to electrodes (which are not shown in FIG. 1). Current supply conductor 5 engages in the niobium tube 6 with some play. A good electric contact between the conductor 5 and the tube 6 is made by a Litze wire 8.

A vacuum prevails in the outer envelope 1 and is maintained by a barium getter evaporating from a ring 9. A glow starter 10 is provided in series with a bimetal switch 11 which together shunt the discharge path in the discharge vessel 3. When the lamp is ignited, a glow discharge occurs in the glow starter 10. After the glow discharge has been extinguished as a result of a rise of temperature in the glow starter, a voltage pulse occurs across the discharge vessel 3 which causes the lamp to ignite. The thermal energy which the discharge radiates opens the bimetal switch 11.

In FIG. 2, the discharge vessel 3 is sealed at its end by a ring 15 of ceramic. A niobium tube 6 passes through the ring 15 and is connected thereto by a bonding material 16, for example, consisting of 32.6% of $Al_2O_3$, 50.4% of CaO, 4.2% of BaO, 10.3% of MgO, 0.1% of SrO, 1.8% of $B_2O_3$, 0.5% of $SiO_2$, 0.1% of $Na_2O$ or of 20.1% $Al_2O_3$, 69.4% CaO, 6.0% of BaO, 3.5% of MgO, 1.0% of $B_2O_3$(%=mol%). A tungsten electrode 17 is welded to the tube 6 and a tungsten wire 18 is wound on the electrode 17. An emitter 19 is present in the cavities between turns of the tungsten wire 18.

EXAMPLE

A discharge vessel had an inside diameter of 4.8 mm and an inside length of 38 mm. The distance between the tips of the electrodes was 28 mm. 2 mg emitter was provided on each of the electrodes in the cavities of the wire turns. The discharge vessel contained 10 mg of sodium amalgam having an Na/Hg weight ratio of 0.375 and xenon at a pressure of $10^4$ Pa at room temperature. During operation the lamp consumed a power of 100 W.

Such lamps provided with different emitters were tested according to a cycle of 5.5 hours on, 0.5 hours off. It was found that lamps tested according to this scheme reach end of life after a smaller number of hours in operation as a result of increase of the lamp voltage than when a cycle of 0.5 hours on, 0.5 hours off, or of continuous operation, was used.

In a first series of lamps (I), electrodes were used which had been dipped in a suspension of 155 g of $SrCO_3$, 55 ml of ethylene glycol, 23 ml of ethyl alcohol, 5 ml of n butyl acetate and 1.5 g of nitrocellulose. After drying the suspension, the electrodes were heated in vacuo at 1250° C. for 50 minutes.

In a second series of lamps (II), electrodes were used on which the same suspension had been provided. After drying the suspension, the electrodes were heated in argon at 1800° C. for 3 minutes.

In a third series of lamps (III), electrodes were used which had been dipped in a suspension of 30 g of SrO, 10 ml of butyl acetate and 1 g of polyethylene oxide-propylene glycol. After drying the suspension, the electrodes were heated in vacuo for 10 minutes at 850° C., 5 minutes at 1060° C., 2 minutes at 1170° C. and 3.5 minutes at 1280° C.

What is claimed is:

1. A high-pressure sodium vapor discharge lamp having a sealed ceramic discharge vessel containing sodium, mercury and rare gas, in which the weight ratio Na/Hg is from 1/1 to 1/9 and the sodium pressure during operation at design voltage is from $4\times10^4$ to $10.7\times10^4$ Pa, current supply conductors extending through the wall of said discharge vessel to tungsten electrodes accommodated inside the discharge vessel, characterized in that an emitter is present on the electrodes which substantially consists of oxygen-bound strontium and oxygen-bound tungsten with the molar ratio of strontium to tungsten being from 3/1 to 50/1 and in which discharge vessel the rare gas pressure at 300° K. is between 1333 and $1333\times10^2$ Pa.

* * * * *